United States Patent [19]

Kruyer

[11] Patent Number: 4,635,860

[45] Date of Patent: Jan. 13, 1987

[54] ROTATIVE GRIZZLY FOR OIL SAND SEPARATION

[76] Inventor: Jan Kruyer, 4643 82nd Avenue, Edmonton, Alberta, Canada, T6B 2L9

[21] Appl. No.: 381,425

[22] Filed: May 24, 1982

[51] Int. Cl.[4] ..... B07B 1/24; B07B 1/58; B02C 17/00; C10G 1/00

[52] U.S. Cl. ..... 241/23; 241/26; 241/284; 241/74; 241/91; 209/11; 209/238; 209/288; 209/294; 208/390; 208/391

[58] Field of Search ..... 209/283, 294, 238, 284, 209/288, 293, 296, 297, 298, 299, 11, 295; 241/81, 79, 85, 91-93, 284, 79.3, 23, 26; 208/11 L, 11 E, 11 R

[56] References Cited

U.S. PATENT DOCUMENTS

| | | | |
|---|---|---|---|
| 1,169,986 | 2/1916 | Middaugh | 209/395 |
| 1,327,572 | 1/1920 | Ryan | 208/11 LE |
| 1,370,620 | 3/1921 | Willson | 209/395 |
| 1,430,790 | 10/1922 | Brown | 209/238 |
| 2,441,386 | 5/1948 | Berg | 208/11 R |
| 2,546,247 | 3/1951 | Wolf | 241/91 |
| 4,043,901 | 8/1977 | Gauld | 209/294 |
| 4,136,832 | 1/1977 | Morita et al. | 241/91 |
| 4,236,995 | 12/1980 | Krayer | 208/11 LE |
| 4,240,589 | 12/1980 | Martin et al. | 209/297 |

FOREIGN PATENT DOCUMENTS

| | | | |
|---|---|---|---|
| 15822 | of 1904 | United Kingdom | 209/298 |

*Primary Examiner*—S. Leon Bashore
*Assistant Examiner*—Thomas M. Lithgow
*Attorney, Agent, or Firm*—Thorpe, North and Western

[57] ABSTRACT

A rotating grizzly having a downwardly slanting axis of rotation for reducing the size of agglomerated mineral particles comprising a rotatable framework made up from a series of spaced axial baffles interconnected by a series of parallel spaced bars wherein the baffles extend inwardly toward the axis of rotation a greater distance than the bars.

15 Claims, 3 Drawing Figures

ROTATIVE GRIZZLY FOR OIL SAND SEPARATION

BACKGROUND OF THE INVENTION

This invention relates to an apparatus and process for reducing the size of agglomerated mineral particles. More particularly, this invention relates to a rotating grizzly and to a method of using the rotating grizzly to reduce the size of mined tar sand particles to facilitate slurry preparation.

Bitumen is presently commercially extracted from mined tar sands using the Hot Water Process. In accordance with this process, the tar sand is first mixed with hot water, sodium hydroxide and steam in a rotating horizontal tumbler, called a conditioning drum. In this operation, the components of the tar sand (i.e. bitumen, water and solids) are dispersed by a combination of heating and dilution with water. More particularly, the heated tar sand comprises grains having bitumen trapped therebetween. As water is added, the sand grains collect therein; the bitumen separates from the grains and forms discrete flecks.

The slurry formed in the conditioning drum is then diluted with additional water and introduced into a separation vessel. This vessel has a cylindrical body and a conical bottom. Here, the coarse sand grains drop to the bottom of the vessel and are removed through an outlet as a tailings stream. This stream is discarded into a pond system. The bitumen flecks, which are slightly less dense than water because of the high process temperature attach themselves to gas bubbles entrained in the slurry rise through the vessel contents and form a froth product. This product overflows the vessel wall into a launder and is collected for further processing and refining. The fine solids remain largely suspended in the water of the separation vessel.

Another method of bitumen extraction from mined tar sand is provided by the Oleophilic Sieve Process disclosed in Canadian Pat. No. 1,085,760 issued on Sept. 16, 1980, U.S. Pat. No. 4,224,138 issued on Sept. 23, 1980, and U.S. Pat. No. 4,236,995 issued on Dec. 2, 1980.

In accordance with the general concepts of the Oleophilic Sieve Process, tar sand is mixed with water and usually steam to form a slurry and remove the bitumen phase from between the sand grains by a combination of tumbling, heating, and dilution with water. The slurry product is then temporarily contained or supported by an oleophilic sieve-like member. Most of the slurry solids drop through the apertures of the sieve-like member, while most of the bitumen adheres to its surface as it comes in contact therewith. The coated section of the sieve-like member then rotates or moves away from the slurry and the bitumen is recovered therefrom.

In both the Hot Water Process and the Oleophilic Sieve Process, slurry preparation is prerequisite for effective separation of bitumen from the tar sand which requires considerable mechanical and thermal energy to break down the lumps of mined tar into a smooth slurry.

The conditioning or slurry preparation step may be thought of as an ablation process where lumps of cold tar sands are tumbling in a conditioning drum. In this drum, the lumps are tumbling in the warm slurry, causing the surface of the lumps to increase in temperature and water content which results in the tar sand sloughing off these lumps to form a smooth slurry.

This ablation or heating and sloughing off mechanism requires a long residence time in the drum when the tar sand lumps are large and a progressively shorter time as the lump size of tar sand entering the drum becomes smaller.

It would therefore, be beneficial to reduce the size of the tar sand lumps prior to introduction of the mined tar sand into the conditioning drum to facilitate slurrying and reduce energy requirements.

Mined tar sands may contain other particles which require size reduction or disposal. Lumps of clay containing little or no bitumen may be present. Lumps of tar sands held together by the stickiness of the bitumen may also require reduction in size. In addition, tramp materials such as rocks, vegetation such as tree limbs, roots and trunks may be present and require separation and disposal.

There are also other types of materials which require particle size reduction which are not related to the processing of tar sands. One such example would be the breaking up of friable particles such as soft coal.

As used in this invention, all materials requiring size reduction whether homogeneous or heterogeneous will be referred to as "agglomerated" particles.

OBJECTS AND BRIEF DESCRIPTION OF INVENTION

It is an object of the present invention to provide an apparatus and method for reducing the particle size of agglomerated mineral materials and tar sands in particular.

It is also an object of the invention to provide an apparatus and method for reducing the particle size of agglomerated mineral particles within the framework of a rotating grizzly.

A further object of the present invention is to provide an apparatus and method for the breaking up of agglomerated tar sand particles in a rotating grizzly, and the classification of such tar sand particles as determined by their ability to be broken into smaller sizes and fall through the rotating grizzly framework.

These and other objects may be accomplished by means of a rotating grizzly mounted such that the axis of rotation is slightly slanted from a horizontal position. The grizzly is made up of axial baffles spaced about the axis of rotation and interconnected by a series of bars which are parallel to each other. The bars thus interconnect adjacent baffles and are separated from each other in a parallel relationship by apertures of from about one to ten inches. The baffles preferably have greater depth than the bars and are interconnected with the bars such that the baffles extend inwardly in the grizzly framework a greater distance than do the bars. The grizzly framework as described, has an open entrance end and an open exit end. The exit opening may be of the same or smaller diameter than the entrance opening. The framework may therefore, be in the form of a cylinder or a truncated cane. However, if the adjoining bars are straight and not curved, the transverse cross-section of the grizzly may be polygonal varying from triangular on up, depending upon the number of baffles. Ribs, parallel to the baffles, may be attached to the inner surface of the bars and serve the same lifting function as the baffles. Inwardly protruding studs or spikes may be attached to the baffles or bars in a random or uniform fashion to assist in breaking up agglomerated mineral particles as will be described.

The grizzly framework is mounted in a support base so as to rotate in the base. The framework is mounted such that the axis of rotation is slanted slightly downwardly from the front end to the rear. If the diameter at the front end of the framework is greater than at the rear, the axis of rotation still slants downwardly even though the lower portion of the rotating framework at the front end is slightly lower than, horizontal with or higher than the lower portion at the rear end so that mineral particles entering the front end and not falling through the apertures between the bars will migrate toward the rear due to the downwardly slanting axis of rotation.

Drive means are mounted on the support to rotate the grizzly framework.

The grizzly framework, as described, operates to reduce the particle size of the agglomerated mineral particles and tar sands in particular. The agglomerated particles are fed into the open entrance end by a conveyor belt, front end loader or any other means. Particles smaller than the space between the bars fall through framework as it rotates. The larger particles, which are frozen or cohesively held and the tramp materials are picked up by the baffles or ribs and are rotated until they fall by gravity back to the bottom of the framework. These falling particles strike the baffles, bars, studs or spikes or other particles and upon impact may break into smaller particles. The impacted particles which are small enough fall through the framework apertures and the larger particles are again lifted and fall in a subsequent cycle. Each time particles are lifted and fall, they migrate toward the exit end of the framework due to the downward slope of the axis of rotation.

Receiving means are contained in the support framework, or may be separately located, to capture the particles as they fall through the apertures in the rotating grizzly framework and direct such particles to a bin, conveyor or other disposal or storage means. Preferably, the particles are placed on a conveyor and are carried directly to a tumbler or other apparatus where they are admixed with heated water, steam or mixtures of water and steam to form a slurry.

Since the agglomerated particles entering the grizzly framework may not be uniform in cohesiveness or composition the easier to break particles will fall through the apertures at the entrance end of the grizzly framework and the more cohesive particles will require more rotating and impacting to be broken apart. Hence, they will exit further down the length of the grizzly framework. Thus, clay lumps may break less readily than tar sand particles of high bitumen content. It is therefore, possible to classify particles falling through the framework according to where they exit along the length thereof.

It may be beneficial to divide the receiving means along the length of the framework into sections for purposes of classification and subsequent processing or disposal. Each such section will be provided with separate conveying or storage means.

To expedite the breakup of agglomerated particles, the framework may be enclosed by a cover and the enclosed area may be heated by steam, hot air or other means to thaw frozen particles, reduce the cohesiveness of tar sand particles by lowering bitumen viscosity and otherwise facilitate the breakup of larger particles into smaller sizes.

Tramp materials such as rocks, pieces of wood and other debris are removed from the exit end of the grizzly framework and disposed of.

DRAWINGS OF THE INVENTION

DETAILED DESCRIPTION OF THE INVENTION

Figure 1:
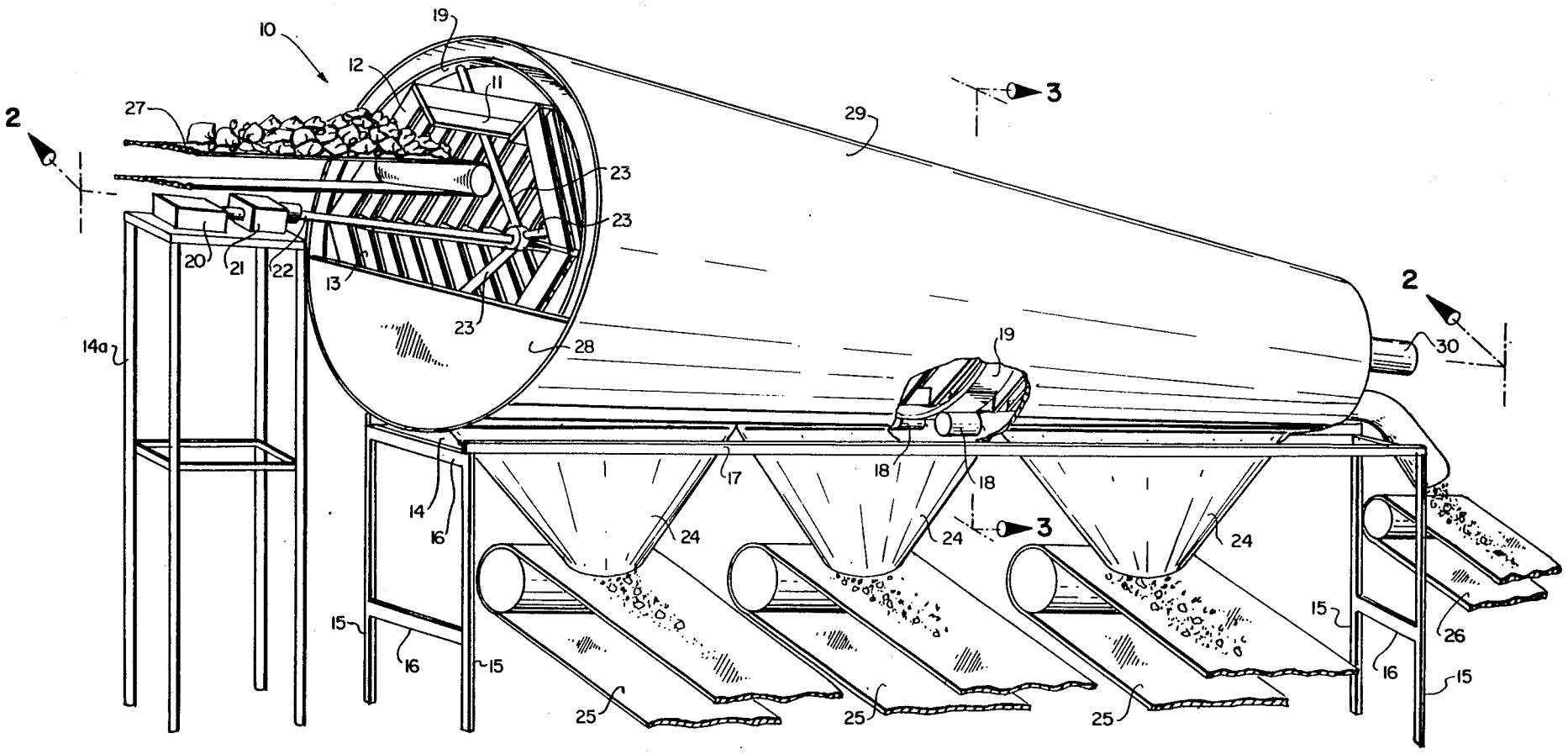
FIG. 1 is a pictoral view of one embodiment of the invention showing a grizzly framework in the shape of a hexagonal truncated cone.
Figure 2:
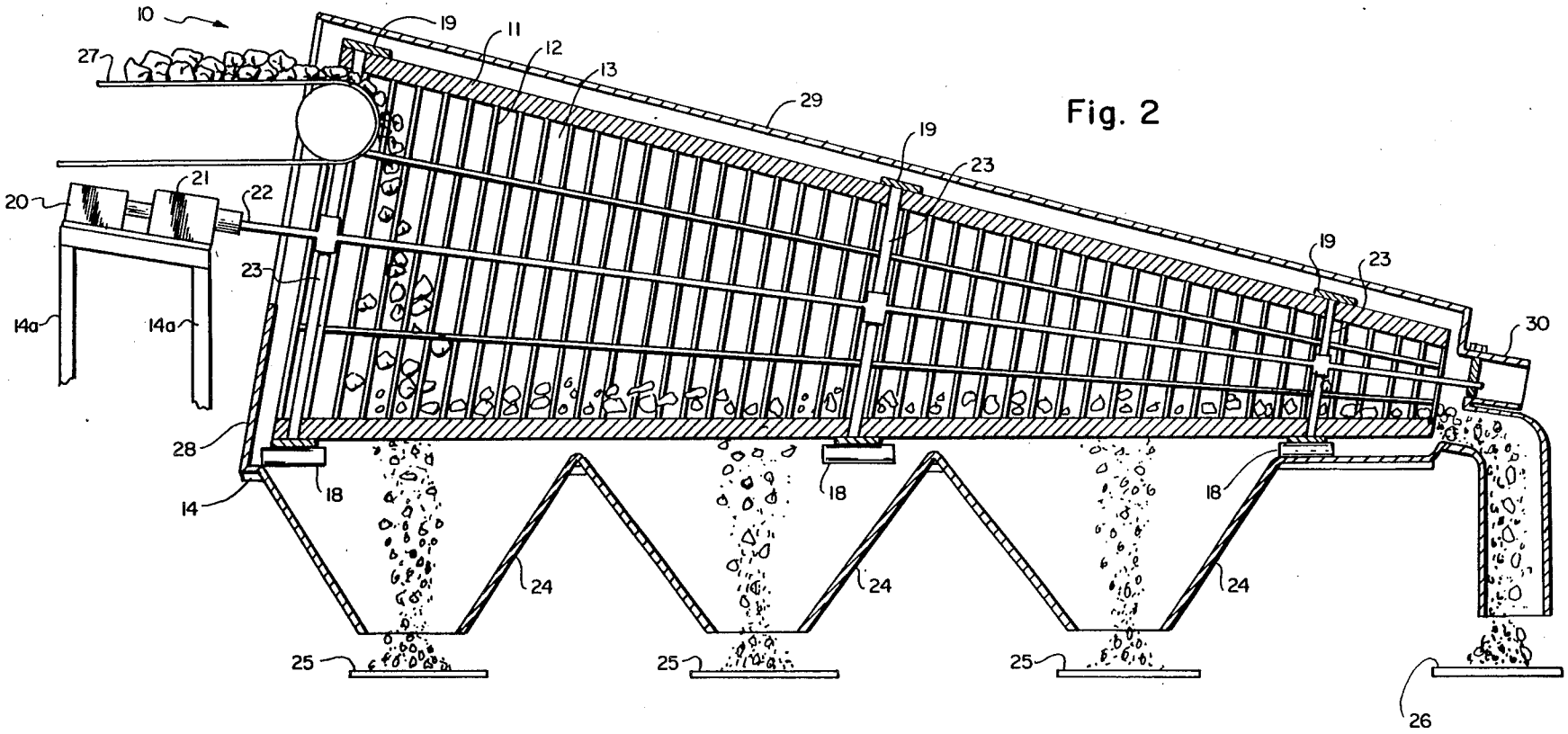
FIG. 2 is a longitudinal cross-sectional view of the grizzly assembly shown in FIG. 1, taken along lines 2—2 of FIG. 1
Figure 3:
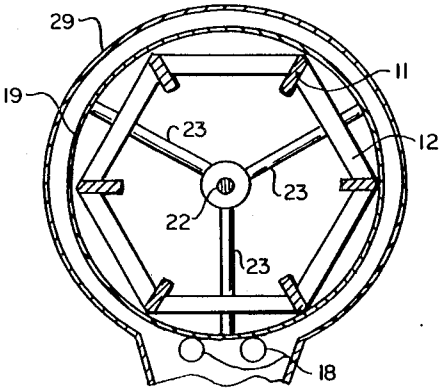
FIG. 3 is a transverse cross-sectional view of the grizzly assembly shown in FIG. 1, taken along lines 3—3 of FIG. 1.

There is shown in FIGS. 1–3 a complete embodiment of the invention.

The grizzly system centers around a rotatable grizzly framework 10 which is made up of spaced axial baffles 11, interconnected by a series of parallel spaced bars 12. Preferably, the baffles are equidistantly spaced from other baffles as are the bars. However, it is not required that the spacing be uniform in all instances. For example, the bars 12 at the front end of the framework 10 may be closer together than the bars 12 toward the rear. In any event, the bars 12 interconnect adjacent baffles, are preferably parallel to each other and are spaced apart to create apertures or spacings 13 of from about one to ten inches. Spacings of from about one to five inches are preferred.

Since the baffles 11 preferably have greater depth than the bars 12 they protrude inwardly in the framework a greater distance than do the bars. The baffles thus function as lifters to lift agglomerated mineral particles within the framework as it rotates. The invention does not preclude the use of baffles having the same or lesser depth than the bars. The baffles 11, are preferably rectangular in cross-section but may be of any other shape. The bars are also preferably rectangular in cross-section but may be circular or of any other shape. The bars may be interconnected to the baffles by welding or any other means.

Bars 12 may be straight or arcuate. If the bars are straight, the transverse cross-section of the framework will be polygonal as shown in FIG. 3. If the bars are arcuate or curved, the transverse cross-section may be circular.

The grizzly framework 10 is open at the ends. The diameter of framework 10 may be uniform from one end to the other or the entrance end may have a larger diameter than the exit end. Taking into consideration that the cross-section of the framework may be either circular or polygonal in shape and without differentialing between these shapes, the framework may be either generally cylindrical or in the form of a truncated cone.

If desired, the framework may also contain other attachments to assist in particle size reduction. Ribs (not shown) attached to the inner surfaces of the bars and parallel to the baffles may serve to improve the lifting ability of the framework as it rotates. Also inwardly extending studs or spikes (not shown) attached to the bars or baffles may facilitate the breakup of falling agglomerated particles.

The grizzly framework 10 is rotatably mounted in or on a support base 14 in such a manner that the axis of rotation of the framework slants slightly downwardly from the front end to the exit end. The axis of rotation will not be more than about 15° from a horizontal plane and preferably not more than about 10°. The particular design of the support is not critical so long as it supports the grizzly framework in a functional manner.

The purpose of the downward slant of the axis of rotation is to keep materials entering the entrance end of the framework migrating toward the exit end. If the framework 10 is generally cylindrical, the floor or lower portion of the framework will always be elevated at the entrance end. However, if the framework is in the form of a truncated cone, the floor at the entrance end may be elevated, horizontal with, or slightly lower than the exit end. As illustrated in FIG. 2, the baffles 11 that are in other than the floor position will slope downwardly from the entrance to the exit end and as they are rotated will keep materials moving toward the exit end of the framework due to the downward slant of the lifting action of the baffles.

As illustrated in the drawings, the support base 14 consists of a bench-like structure having legs 15 interconnected by cross arms 16 and side supports 17. Rollers 18 mounted in cross arms 16 engage rotation collars 19 which encircle the framework exterior in appropriate locations and rotatably support the grizzly framework 10.

The grizzly framework is rotated by drive means which may be any of numerous conventional systems. As illustrated, a motor 20 mounted on a elevated portion of the support means 14*a* is connected through a gear box 21 to a drive shaft 22 which extends through the framework along the axis of rotation. The drive shaft is secured to the framework 10 and collars 19 by connecting rods 23 which rotate the framework as the shaft is driven.

Other means can be utilized to rotate the grizzly framework without requiring the use of a driveshaft extending through the center of the framework. For example, a sprocket wheel can be placed about the outer circumference of the framework which can then be chain or gear driven.

Whatever means are used, the drive means should operate to rotate the framework at a speed of between about 0.1 to 100 rpm and preferably between 0.5 to 10 rpm.

The area immediately below the framework contains receiving means which may be in the form of guide plates 24 to direct the particles falling through the apertures 13 to removal means which may be in the form of a conveyor belt 25 as illustrated. The guide plates may direct the material falling through the apertures onto a single belt or, as illustrated, the guide plates may be sectioned along the length of the grizzly framework to direct the particles falling through a certain portion of the framework onto separate conveyor belts.

A separate conveyor 26 may be added at the exit end of the grizzly framework to remove oversize material which cannot be or has not been reduced in size sufficient to fall through apertures 13 in the framework and on to belt 25. Oversize or tramp material will generally consist of rocks, tree limbs, trunks or roots, or other forms of solid debris.

A conveyor 27 or other loading means conveys the agglomerated particles into the entrance end of the grizzly framework 10. To keep the entering particles from spilling out the entrance end of framework 10, the portion of the entrance below conveyor 27 may be covered with an end plate 28.

If the grizzly system is to operate in a cold environment or if the agglomerated material is found to break up more easily in a hot environment, it is possible to surround the grizzly framework with a cover or housing 29. Heating means 30 may then direct hot air or steam into the interior of framework 10. Various forms of heating may be used. Forced hot air may be blown in at either or both ends of framework 10. Hot air or steam pipes may extend into the interior of the framework to release hot air or steam along the entire length of the framework or at least at specific points. The heating of the interior of the framework will cause frozen agglomerated particles to thaw and be reduced in size. Likewise, tar sand particles which are too cohesive to break into smaller pieces will become less cohesive when heated as the viscosity of the bitumen in the heated tar sand is reduced.

The size of the grizzly system may vary considerably and is not considered to be a limitation of the invention. For small systems, a grizzly framework of only a matter of a few feet in length may be sufficient. For larger operations, the length of the framework may be expanded to provide a system up to about 70 feet or more in length.

The general mode of operation of the grizzly system has already been described. The system may be utilized to reduce the particle size of any agglomerated mineral particles but is particularly adapted to reduce the particle size of mined tar sands which are also referred to as oil sands.

In its preferred usage, raw mined tar sand is deposited onto a belt 27 and fed to the entrance end of a rotating grizzly framework 10. The framework 10 is rotated by a drive chain consisting of motor 20, gearbox 21, drive shaft 22 and connecting rods 23. The framework 10 is covered by cover 29 to retain heat which is supplied by hot gas line 30. Preferably, the hot gas will be heated air but may also be hot flue gas, steam, or any other hot industrial gas that does not negatively affect the bitumen through chemical reaction or contamination. The smaller or more easily broken tar sand particles fall through apertures 13 toward the entrance end of framework 10 and are carried away via conveyor means 25. The remaining tar sand particles are moved within the heated framework interior by the lifting action of baffles 11 and fall from the baffles in a rearwardly migrating action to impact against bars 12, baffles !1, or other particles. As each particle is sufficiently reduced in size, it falls through apertures 13 and is directed by a guide plate 24 onto a conveyor 25 for removal. The introduction of hot gas, air or steam hastens the thawing of frozen particles and facilitates break up.

Since agglomerated mined tar sands with higher frozen clay content may break less readily, it is possible to segregate or classify the tar sands passing through apertures according to clay content or quality. The segregated tar sands may then be made into a slurry under conditions which are appropriate for that particular quality of sand. Oversize materials will not pass through the apertures and migrate to the exit end of framework 10 where they are discharged onto belt 26 for further treatment of disposal.

While the invention has been described in terms of its preferred embodiment, other equivalent means, methods or materials may be utilized without departing from the scope of the invention which is to be limited only by the appended claims. For example, to conserve heat, the cover may be formed to totally enclose the grizzly with the inlet and the outlet designed to constrain the loss of hot air from the enclosure.

I claim:

1. A grizzly assembly for particle size reduction of agglomerated mineral materials consisting of a mined tar sands mixture composed of particulate solids and viscous liquid hydrocarbon bitumen with or without water comprising:

(a) A rotatable grizzly framework having an entrance at one end and an exit at the opposite end consisting of a series of equidistantly spaced axial baffles, each being interconnected to an adjacent baffle by a series of parallel bars which bars are secured at either end thereof to said adjacent baffles and which are spaced to create apertures between the bars, said baffles extending inwardly toward the framework axis a greater distance than do said parallel spaced bars, (b) support means for rotatably holding said framework in a near horizontal position such that the framework axis slants downwardly from the entrance end to the exit end, (c) drive means to rotate said framework in said suport means, (d) receiving means below said grizzly framework to receive mineral particles falling through the framework apertures, (e) cover means surrounding said grizzly framework, and (f) means to introduce heat into the interior of the grizzly framework.

2. A grizzly assembly according to claim 1 wherein the parallel bars are spaced such that the aperture width between the bars is from about 1 to 10 inches.

3. A grizzly assembly according to claim 1, wherein the parallel bars are equidistantly spaced from each other.

4. A grizzly assembly according to claim 1 wherein the receiving means is divided into sections along the length of the framework.

5. A grizzly assembly according to claim 1 wherein the grizzly framework is of uniform diameter along its entire length.

6. A grizzly assembly according to claim 1 wherein the grizzly framework decreases in diameter from the entrance end to the exit end and wherein the lower portion of the entrance end is horizontal with or inclined relative to the lower portion at the exit end.

7. A grizzly assembly according to claim 1 wherein said parallel bars are straight and the grizzly framework is polygonal in transverse cross-section.

8. A grizzly assembly according to claim 1 wherein said parallel bars are arcuate and the grizzly framework is circular in transverse cross-section.

9. A grizzly assembly according to claim 1 additionally containing conveyor means extending into the entrance of the grizzly framework to introduce mineral materials into the grizzly framework interior.

10. A grizzly assembly according to claim 9 also containing conveyor means below the receiving means to remove mineral particles falling through the framework apertures.

11. A method for reducing the particle size of agglomerated mineral materials consisting of a mined tar sands mixture composed of particulate solids and viscous liquid hydrocarbon bitumen with or without water comprising:

(a) providing a grizzly assembly comprising:

(i) a rotatable grizzly framework having an entrance at one end and an exit at the opposite end consisting of a series of equidistantly spaced axial baffles, each being interconnected to an adjacent baffle by a series of parallel bars which bars are secured at either end thereof to said adjacent baffles and which are spaced to create apertures between the bars, said baffles extending inwardly toward the framework axis a greater distance than do said parallel spaced bars, (ii) support means for rotatably holding said framework in a near horizontal position such that the framework axis slants downwardly from the entrance end to the exit end, (iii) drive means to rotate said framework in said support means, (iv) receiving means below said grizzly framework to receive mineral particles falling through the framework apertures, (v) cover means surrounding said grizzly framework, and (vi) means to introduce heat into the interior of the grizzly framework, (b) introducing agglomerated mineral particles into the entrance end of said rotatable grizzly framework, (c) causing said agglomerated mineral particles in said rotating grizzly framework to be lifted by the rotating framework until such particles fall by gravity to a lower portion of the rotating framework and are broken upon impact into smaller particles which either fall through the apertures of the framework onto said receiving means or are again lifted by rotation of the framework with the particles not falling through the apertures migrating from the entrance end toward the exit end of the framework as they pass through successive lifting and falling cycles caused by the rotating framework, (d) directing said particles falling onto said receiving means onto conveying means for recovery, and (e) removing particles which do not pass through the apertures of said rotating framework through the exit end of said framework.

12. A method according to claim 11 wherein said receiving means are sectioned and wherein the particles falling through the apertures of the grizzly framework are directed by said sectioned receiving means along the length of the framework onto separate conveying means for each sectioned receiving means.

13. A method according to claim 11 wherein the agglomerated particles within the rotating grizzly framework are heated by said heating means to facilitate particle breakup.

14. A method according to claim 11 wherein the particles directed onto said conveying means are admixed with heated water to form a slurry.

15. A method according to claim 11 wherein the particles passing through the apertures are less than about two inches in diameter.

* * * * *